United States Patent [19]

Weile

[11] Patent Number: 5,046,629

[45] Date of Patent: Sep. 10, 1991

[54] CONTAINER WITH SCREW CAP

[75] Inventor: Charlotte Weile, Copenhagen, Denmark

[73] Assignee: A/S Dumex, Copenhagen, Denmark

[21] Appl. No.: 555,451

[22] PCT Filed: Feb. 15, 1989

[86] PCT No.: PCT/DK89/00031

§ 371 Date: Sep. 25, 1990

§ 102(e) Date: Sep. 25, 1990

[87] PCT Pub. No.: WO89/07558

PCT Pub. Date: Aug. 24, 1989

[30] Foreign Application Priority Data

Feb. 15, 1988 [DK] Denmark ..... 769/88

[51] Int. Cl.[5] ..... B65D 51/18; B65D 55/02

[52] U.S. Cl. ..... 215/221

[58] Field of Search ..... 215/216, 221, 225

[56] References Cited

U.S. PATENT DOCUMENTS

| | | | |
|---|---|---|---|
| 3,399,796 | 9/1968 | Steiner | 215/221 X |
| 3,514,003 | 5/1990 | Fitzgerald | 215/221 |
| 3,739,934 | 6/1973 | Bruno | 215/216 |
| 3,743,127 | 7/1973 | Morceau | 215/221 |
| 4,106,651 | 8/1978 | Lemons | 215/221 |

*Primary Examiner*—Stephen Marcus
*Assistant Examiner*—Nova Stucker
*Attorney, Agent, or Firm*—Watson, Cole, Grindle & Watson

[57] ABSTRACT

A container comprising a mouth the outside of said mouth comprising an external thread covering only part of the periphery of the mouth to provide at least one axially extending thread-free zone, a screw cap (2) for onscrewing onto the external thread, the skirt of the screw cap (2) comprising a hole (9) and means for preventing an unwanted unscrewing of the screw cap (2) said means consisting of an element (5) which is hinge-connected to the exterior side of the screw cap (2), said element can be swung over and be engaged with the free end of the screw cap, and said element has a projection (12) which extends through the hole (9) and ends in the thread-free zone when the screw cap (2) is in its closing position.

9 Claims, 2 Drawing Sheets

CONTAINER WITH SCREW CAP

Figure 1:
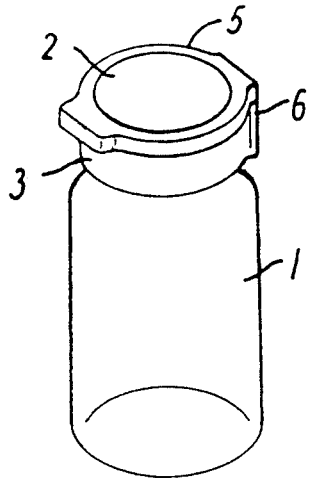

This invention relates to a container comprising a mouth with an external thread covering only part of the periphery of the mouth to provide at least one axially extending thread-free zone, a screw cap for onscrewing onto the thread and means for preventing an unwanted unscrewing of the screw cap, said container also comprising a latching tooth which extends into the thread-free zone when the screw cap is in its closing position.

More particularly the invention relates to a so-called child-proof medicine bottle, i.e. a medicine bottle with a screw cap and safety means which must be disengaged before the screw cap can be unscrewed from the medicine bottle.

U.S. Pat. No. 3,739,934 describes a container of the above-described type, wherein the safety means consist of a flexible latching strip, one end of said latching strip being secured to the screw cap at the centre thereof and the other end of said latching strip having a downwardly projecting latching tooth which is positioned in the thread-free zone when the screw cap in its closing position and prevents the cap from being unintensionally unscrewed.

In case of intended unscrewing of the cap, the external end of the latching strip is raised whereby the latching tooth is retracted from the thread-free zone and when simultaneously turning the screw cap the latter can be unscrewed from the thread.

Such a child-proof closure is difficult to operate for elderly or handicapped people with weak fingers and/or reduced motoricity.

U.S. Pat. No. 3,514,003 describes a container of the above-described type wherein the safety means consists of a segment of the cap. The segment constitutes a part of the skirt of the screw cap and is defined by two slots extending axially away from the free edge of the skirt and by a hinge connection extending between the inner ends of the slots. A locking element or projection is provided on the inner surface of the segment. In the locked condition of the screw cap, the projection of the segment engages the thread-free zone and the segment is secured in the locked position by means of a rubber band arranged in a groove which extends around the skirt of the cap and along the outer surface of the segment so as to hold the segment in continuation of the remainder of the skirt. When the cap is to be unscrewed, the rubber band is moved to another groove positioned further away from the edge of the skirt. The segment is now released from the tension of the rubber band and occupies a natural position in which it stands away from the remainder of the cap with the projection withdrawn from the thread-free zone. Such screw cap is also difficult to operate for people of the kind referred to above.

It is an object of this invention to provide a container of the above-described type with safety means which are easy to operate for people as referred to above, but at the same time are sufficiently complicated to prevent small children from disengaging them.

Still more particularly the present invention relates to a container comprising a mouth with an external thread covering only part of the periphery of the mouth to provide at least one axially extending thread-free zone, a screw cap having a skirt for onscrewing onto the thread and comprising a safety element which is hinge-connected to the screw cap and is provided with a projection which by swinging the safety element about the hinge may be moved into and out of engagement with the thread-free zone. According to the present invention the container is characterized in that the safety element is hinge-connected to the exterior side of the screw cap near the free end of the skirt of the screw cap, that a hole for the projection is provided in the skirt in the area adjacent the position at which the safety element is hinge-connected to the skirt and that the safety element is so adapted that it can be swung over and be engaged with the free end of the screw cap with a part of the safety element protruding outside the periphery of the screw cap distally of the position at which the safety element is hinge-connected to the skirt.

When the screw cap is in its closing position, unscrewing is prevented by the mentioned projection, as the free end of said projection engages the thread and thus prevents rotation when it is attempted to unscrew the cap.

Before opening the container the projection must be disengaged from the thread-free zone on the exterior side of the container mouth. This is effected by swinging the element which is hinge-connected to the exterior side of the screw cap away from the container. Due to the arrangement of the safety element according to the present invention, this can be effected by holding the container with both hands and pressing the part of the safety element situated distally of the hinge joint and protruding outside the periphery of the screw cap, against the edge of a horisontal surface, e.g. the edge of a table and by simultaneously pressing the container downwardly.

When the safety element is disengaged from the end of the screw cap, it is easily swung away from the screw cap and the projection is thereby swung out of the hole in the skirt of the screw cap. This permits a rotation of the screw cap relative to the container.

After the safety element has been swung away from the screw cap it can be used for facilitating the rotation of the screw cap relative to the container by using the leverage effect. Thus the unscrewing can be performed by continuously holding the container with both hands and by pressing the out-swung safety element against a vertical surface, e.g. part of a door frame.

After the screw cap has been placed on the thread following the opening of the container the onscrewing of the cap can easily be effected in the same simple way as described above in connection with the unscrewing of the screw cap.

As described above only a limited muscular strength and a very limited motoricity are required in order to open and close the container of the invention.

The hinge-connected element is preferably shaped as a ring which can be positioned around and be engaged with the free end of the screw cap.

This embodiment is advantageous in that it only slightly hints that a condition to be fulfilled before the cap can be unscrewed is that the safety element is swung away from the screw cap.

In order to make it even more difficult for children to determine how the cap functions, the free end of the screw cap preferably comprises a ring-shaped recess of such a depth and width that the ring-shaped safety element fits into this recess when the cap is in its closing position.

The safety element can also be bar-shaped and in a particularly preferred embodiment a transversely extending recess is formed in the end surface of the screw cap said recess serving to receive the bar-shaped safety element and to maintain it in engagement with the screw cap. Preferably the bar-shaped safety element has such a length that its free end, when in closing position, constitutes the part protruding outside the periphery of the screw cap so that it can easily be disengaged from the screw cap when the container is to be opened.

The hinge preferably comprises two parallel weakening lines one of which is situated in the immediate vicinity of the skirt of the screw cap and the other between the projection and the remaining part of the safety element. This means that the part between the two weakening lines carrying the projection is placed parallel to the exterior side of the screw cap when the cap is in its closing position.

The thread on the exterior side of the container opening can be an integral part of the container which preferably will be the case if the container is produced from a plastic material.

The thread can also be part of a separate thread member which is placed on the container, e.g. a glass bottle. The separate threadmember can e.g. be snapped onto the mouth of the container.

The container of the invention may comprise stop means which ensure that the screw cap is in a predetermined position after being screwed onto the thread such that the hole in the skirt of the screw cap is positioned opposite to the thread-free zone.

Preferably the screw cap with safety element is produced from a plastic material and especially a polyolefine, such as polyethylene and polypropylene and the screw cap is preferably produced by injection moulding.

Figure 2:
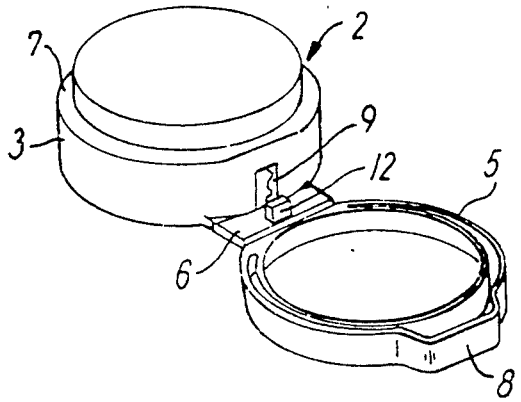
Figure 3:
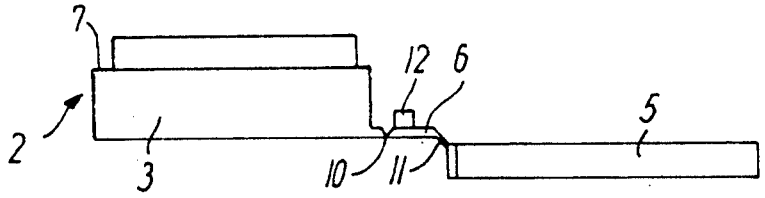
Figure 4:
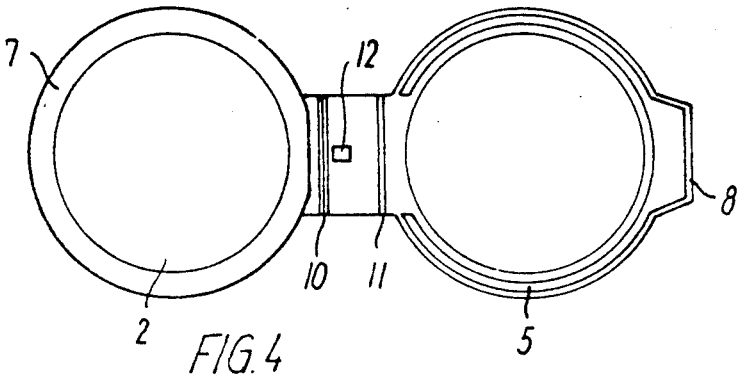
Figure 5:
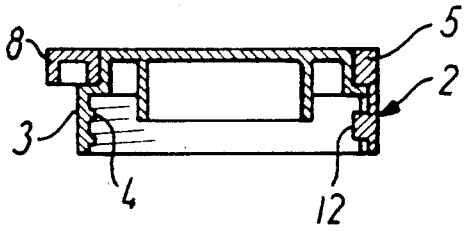
Figure 6:
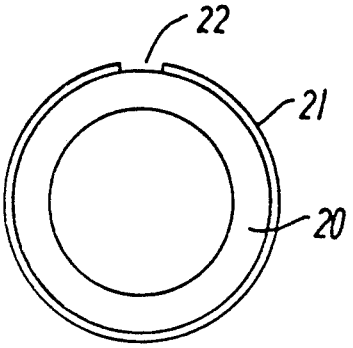
Figure 7:
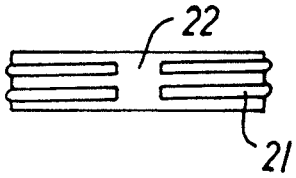
Figure 8:
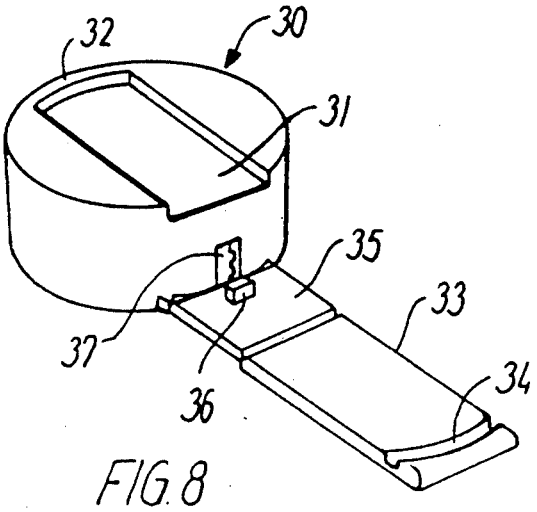

The invention will be described in further detail in which reference is made to the drawing, in which:

FIG. 1 shows a perspective view of a preferred embodiment of a container of the invention with the screw cap in its closing position, FIG. 2 shows a perspective view of the screw cap illustrated in FIG. 1, in its opened position FIG. 3 shows the screw cap illustrated in FIG. 2 in side view, FIG. 4 shows the screw cap illustrated in FIG. 2 seen from above, FIG. 5 shows a vertical sectional view of the screw cap illustrated in FIG. 2 in its closing position, FIG. 6 shows a top view of a separate thread member for a container of the invention, FIG. 7 shows the thread member illustrated in FIG. 6 from the side, and FIG. 8 shows a perspective view of another screw cap for a container of the invention.

In the drawing 1 is a medicine bottle with a screw cap 2 comprising a cap skirt 3 with an inner thread 4 (see FIG. 5). The screw cap 2 is provided with a safety element comprising a safety ring 5 which is hinge-connected to the exterior side of the skirt 3 of the screw cap 2 at a position near the free end of the skirt by means of a hinge joint 6.

As can be seen on FIGS. 2-5 the screw cap 2 comprises at its free end a ring-shaped recess 7 serving for receive and maintain the safety ring 5 in the closing position of the screw cap 2. On the other side of the safety ring 5 which is situated distally of the hinge joint 6 the safety ring has a protruding part 8. In the area adjacent the hinge joint 6 there is a hole 9 in the skirt 3 of the screw cap 2. The hinge joint 6 comprises two parallel weakening lines 10 and 11, along which a bend is effected when the safety ring 5 is moved from the open position (see FIG. 2-4) to the closing position (see FIG. 1 to 5) and vice versa.

Between the weakening lines 10 and 11 there is a projection 12, which is swung into the hole 9, see FIG. 5 when the position of the safety ring 5 is changed from open to closing position.

A separate thread part 20 illustrated in FIG. 6 and 7 is adapted to be snapped onto the mouth of a medicine bottle as illustrated in FIG. 1. The thread part 20 comprises a thread 21 which does not extend through an axially extending zone 22. By onscrewing of the screw cap 2 as illustrated in FIGS. 2-5 onto the thread 20 the screw cap will be in such a position that the hole 9 in the cap skirt 3 is opposite to the zone 22 when the cap is in closing position.

The screw cap 30 illustrated in FIG. 8 has a recess 31 in its end surface, said recess being limited by a circular-shaped bead 32 located at one end thereof.

The safety element consist of a bar-shaped element 33 having at its distal end a groove 34 with a shape corresponding to that of the bead 32.

The screw cap 30 comprises a hinge joint 35 with a projection 36 for introduction into a hole 37 at the edge of the skirt of the screw cap 30.

I claim:

1. A container comprising a mouth with an external thread covering only part of the periphery of the mouth to provide at least one axially extending thread-free zone, a screw cap having a skirt for onscrewing onto the thread and comprising a safety element which is hinge-connected to the screw cap and is provided with a projection which by swinging the safety element about the hinge may be moved into and out of engagement with the thread-free zone, wherein the safety element is hinge-connected to the exterior side of the screw cap near the free end of the skirt of the screw cap, wherein a hole for the projection is provided in the skirt in the area adjacent the position at which the safety element is hinge-connected to the skirt, and wherein the safety element is so adapted that it can be swung over and be engaged with the free end of the screw cap with a part of the safety element protruding outside the periphery of the screw cap distally of the position at which the safety element is hinge-connected to the skirt.

2. A container according to claim 1, wherein the hinge-connected element has the shape of a ring which can be placed around and be engaged with the free end of the screw cap.

3. A container according to claim 2, wherein the free end of the screw cap has a ring-shaped recess with such a depth and width that the ring-shaped safety element fits into this recess.

4. A container according to claim 1, wherein the safety element is bar-shaped.

5. A container according to claim 4, wherein the free end of the screw cap comprises a transversely extending recess for receiving and securing the bar-shaped safety element to the screw cap.

6. A container according to claim 5, wherein the bar-shaped safety element has such a length that the free end thereof constitutes the part protruding outside the periphery of the screw cap.

7. A container according to claim 1, wherein the hinge comprises two parallel weakening lines, one of which is situated in the immediate vicinity of the skirt of the screw cap and the other between the projection and the remaining part of the safety element.

8. A container according to claim 1, wherein a separate thread is provided on the container mouth.

9. A container according to claim 1, wherein the screw cap and the safety element consist of plastic.

* * * * *